US005263920A

United States Patent [19]

Budza et al.

[11] Patent Number: 5,263,920

[45] Date of Patent: Nov. 23, 1993

[54] ROLLING-MILL ROLL

[75] Inventors: Jury G. Budza; Eduard A. Kuzmenko, both of Novosibirsk; Vladimir S. Samoilov, Moscow; Vladimir I. Zimarev, Novosibirsk, all of Russian Federation

[73] Assignee: Obiedinenie "Sojuztverdosplav" Spetsialnoe proizvodstvenno-tekhnologicheskoe bjuro "Orgprimtverdosplav" Predpriyatie "Altvin", Novosibirsk, Russian Federation

[21] Appl. No.: 959,048

[22] Filed: Oct. 9, 1992

[51] Int. Cl.[5] ..... H05B 5/08; B21B 31/08

[52] U.S. Cl. ..... 492/8; 492/15; 492/40; 492/46; 219/10.492

[58] Field of Search ..... 492/8, 15, 40, 46, 47; 219/10.492, 10.61 A, 244; 165/89, 90

[56] References Cited

U.S. PATENT DOCUMENTS

| | | | |
|---|---|---|---|
| 375,352 | 12/1887 | Handloser | 492/46 X |
| 3,620,061 | 11/1971 | Cunningham et al. | 492/15 X |
| 3,902,233 | 9/1975 | Ohtsu | 492/40 X |
| 4,005,302 | 1/1977 | Graf et al. | 219/10.492 X |
| 4,274,185 | 6/1981 | Mifune et al. | 492/40 X |
| 4,304,975 | 12/1981 | Lenk et al. | 219/10.492 |
| 4,631,794 | 12/1986 | Riihinen | 492/46 X |
| 5,074,019 | 12/1991 | Link | 492/46 X |

*Primary Examiner*—Timothy V. Eley
*Attorney, Agent, or Firm*—Collard & Roe

[57] ABSTRACT

The present invention relates to rolling practice. The proposed roll comprises a sleeve with a hard-alloy insert having a working surface and an element for protection of the insert against electrochemical wear. The element comprises an inductor coil located on the sleeve, and a magnet fixed stationary nearby the coil. Parts of turns of the coil located on the side of its outer surface are electrically connected to the hard-alloy insert, and parts of turns of the coil located on the side of its inner surface are adapted to be in electric contact with the coolant fluid.

3 Claims, 2 Drawing Sheets

ROLLING-MILL ROLL

FIELD OF THE INVENTION

The present invention relates generally to rolling practice and has particular reference to rolling-mill rolls.

The present invention can find most utility when applied for hot rolling, in particular, that of copper and copper-bearing alloys, as well of steel.

BACKGROUND OF THE INVENTION

Known in the art is a rolling-mill roll (FR,A, 2, 169,975), comprising a mandrel with a hard-alloy sleeve provided with an element for protecting against electrochemical wear, incorporating a direct current souurce, provision being also made for a coolant fluid feeding device. The element for protection against electrochemical wear appears as anode rings rigidly fixed in circular recesses made on the periphery of the hard-alloy sleeve. The anode rings are made of a material the electric potential of which is below that of the hard alloy the sleeve is made from.

Such a construction of the roll provides for cathodic protection of the hard-alloy sleeve against electrochemical wear as follows. The anode rings in the medium of the coolant fluid which acts as electrolyte, establish a direct current source that generate current of cathodic protection of the hard-alloy sleeve against electrochemical wear.

However, the anode rings are liable to dissolution during the rolling process, with the result that their surface gets covered with the dissolution products, which disturbs electric contact between the anode rings and electrolyte. Since a potential difference at the contact interface between the anode rings and electrolyte is not high enough to overcome the resistance offered by the products of dissolution of the anode rings, the cathodic protection current is drastically diminished and might disappear altogether, which will result in electrochemical wear inflicted upon the hard-alloy sleeve working surface.

According to another embodiment of said roll the element for protection against electrochemical wear is essentially an anode shaped as a slider adapted to be pressed against the sleeve by an elastic force.

However, in such a construction the anodes are as a rule made of such non-wear-resistant materials as aluminum and magnesium, whereas the rolling speeds in modern rolling mills are as high as 100 m/s. Thus, intense wear on the spring-loaded anodes occurs, which is fraught with frequent stops for replacement of the wornout anodes.

Known in the art is another rolling-mill rolls (SU, A, 1,366,251) comprising a mandrel with a sleeve which has a slot accommodating a hard-alloy insert which has a working surface, and an element for protection against electrochemical wear, said element incorporating a direct current source, a coolant fluid feeding device being also provided. The element for protection of the hard-alloy insert working surface against electrochemical wear is essentially an anode shaped as a number of sliders fitted in the sleeve slot and adapted to contact the working surface of the hard-alloy insert. The sliders are mounted on a horizontal shaft with a possibility of a limited turning, each of them having two projections adapted to contact the respective paired work roll, with the result that the sliders move lengthwise the hard-alloy insert, whereby the oxide film is removed from the slider surface, said film resulting from anode dissolution on its surface contacting the hard-alloy insert. It is the absence of such oxide film on the anode surface that accounts for for a constant intensity of the protection (cathodic) current, the intensity of said current depending on the material of the anode and on the resistance of electrolyte (i.e., the coolant fluid). The length of the slider displacement with respect to the hard-alloy insert is very short, being as small as one millimeter per revolution of the roll so that the slider does not practically sustain any wear within a prolonged period of time.

However, since coolant fluid is fed to the roll at a high pressure, it is splashed about so that its continuity is affected, with the result that the electrical resistance of the fluid rises abruptly. The source of direct current being the anode, the cathodic current is reduced due to a high electrical resistance offered by the coolant fluid, whereas the magnitude of the cathodic protection current is not high enough to ensure against electrochemical wear on the working surface of the hard-alloy insert.

SUMMARY OF THE INVENTION

It is an essential object of the invention to provide higher wear resistance of the proposed rolling-mill roll.

The foregoing object is accomplished due to the fact that in a rolling-mill roll comprising a mandrel with a sleeve which has a slot, wherein a hard-alloy insert is rigidly fitted, said insert having a working surface and being provided with an element for protection of its working surface against electrochemical wear, said element incorporating a direct current source, provision being also made in said roll for a coolant fluid feeding device, according to the invention, the element for protection of the hard-alloy working surface against electrochemical wear comprises at least one inductor coil situated on the sleeve, parts of turns of said coil located on the side of its outer surface being electrically connected to the hard-alloy insert, while parts of the coil turns located on the side of inner coil surface are capable of getting in electric contact with the coolant fluid, and the direct current source is established by a magnet fixed stationary nearby the inductor coil.

Such a construction of the element for protection of the hard-alloy insert against electrochemical wear makes it possible to provide a required magnitude of the cathodic protection current, which practically rules out any electrochemical wear on the hard-alloy insert working surface.

It is expedient that the sleeve be provided with at least one additional slot for the inductor coil to accept.

Such a construction is convenient for retaining a definite size of the rolling-mill rolls.

Whenever two additional slots are made in the sleeve, it is expedient that said slots be situated oppositely to the hard-alloy insert.

Such a construction provides for a higher magnitude of the cathodic protection current when rolling metals having an electric potential value in a medium of a coolant fluid featuring a relatively high electrical resistance value.

BRIEF DESCRIPTION OF THE DRAWINGS

Further objects and advantages of the present invention will become more apparent hereinbelow from a consideration of a specific exemplary embodiment thereof with reference to the accompanying drawings, wherein:

FIG. 7 is a schematic view, in longitudinal section, of a rolling-mill roll, according to the invention;

DETAILED DESCRIPTION OF THE INVENTION

Figure 1:
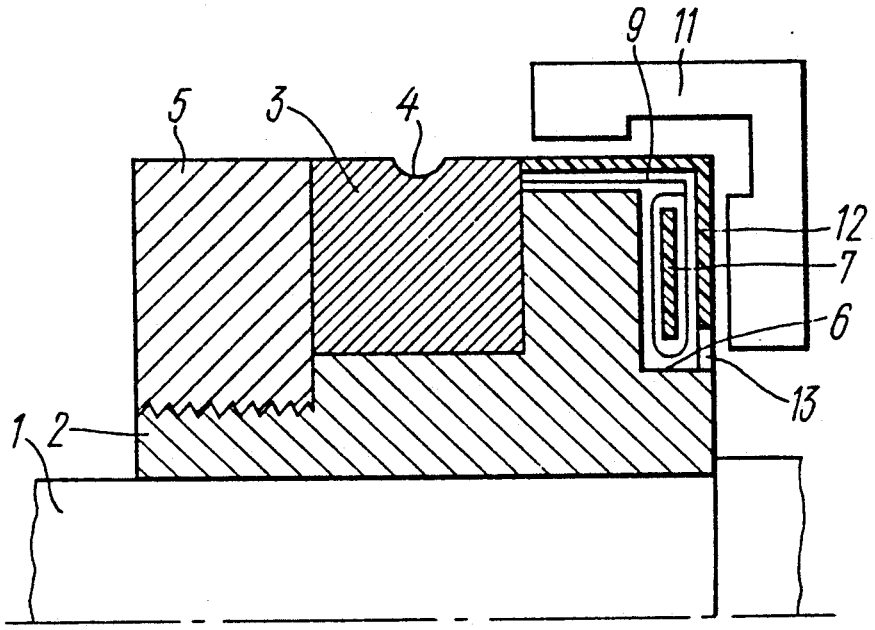
Figure 2:
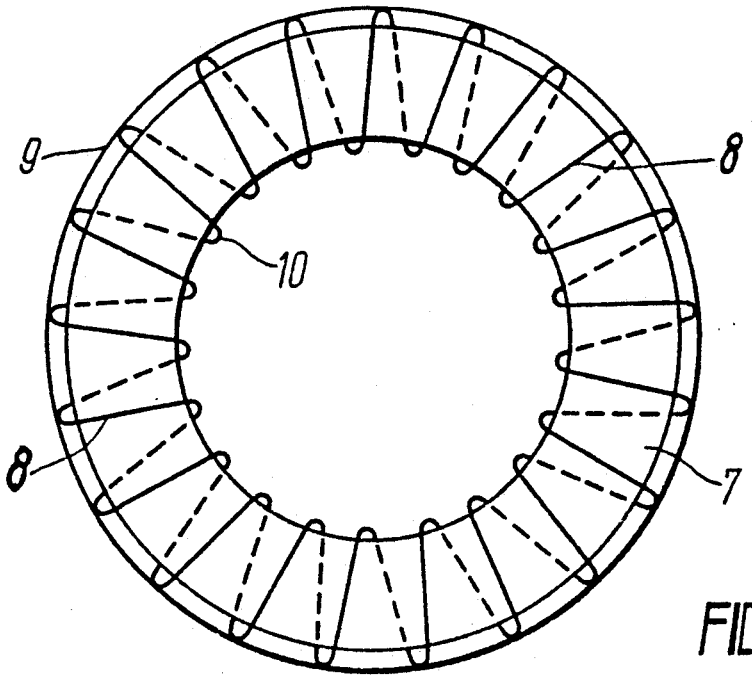
FIG. 2 is a schematic scaled-up plan view of an inductor coil of the rolling-mill roll of FIG. 1.

The herein-proposed roll comprises a mandrel 1 (FIG. 1) which carries a sleeve 2 having a slot, wherein a hard-alloy insert 3 in rigidly fitted, said insert having a working surface 4. The sleeve 2 incorporates a nut 5 fixing in position the hard-alloy insert 3 provided with an element for protection of the working surface 4 of the insert 3 against electrochemical wear. Besides, the roll of the invention has a device (omitted in the Drawing) for feeding a coolant fluid. A slot 6 is provided in the end face of the sleeve 2. The element for protection against electrochemical wear is essentially an inductor coil 7 accommodated in the slot 6 of the sleeve 2. The coil 7 (FIG. 2) is wound with a copper wire coated with an insulant and forming a plurality of turns arranged between the outer and inner surfaces of the coil 7. Parts 8 of the coil turns located on the side of the outer surface of the coil 7 are electrically connected to the hard-alloy insert 3 through a conductor 9, which is in fact a copper wire soldered to each part 8 along the perimeter of the coil 7 to establish a closed circuit connected, by the same copper wire, to the hard-alloy insert 3 (FIG. 1). Parts 10 (FIG. 2) of each turn of the coil 7 located on the side of its inner surface are stripped of the insulant for better electric contact with the coolant fluid, which is indispensable for closing the circuit of the cathodic protection current. The element for protection of the working surface 4 against electrochemical wear incorporates also a direct current source established by a magnet 11 (FIG. 1) stationary fixed in the mill stand (omitted in the Drawing) close to the coil 7, a permanent magnet being made use of in this particular case. The additional slot 6 accommodating the coil 7 is covered by a guard 12 made of an insulant and aimed at holding the coil 7 in position and protecting it against damage. The guard 12 has an opening 13 for the coolant fluid to pass to the additional slot 6.

Figure 3:
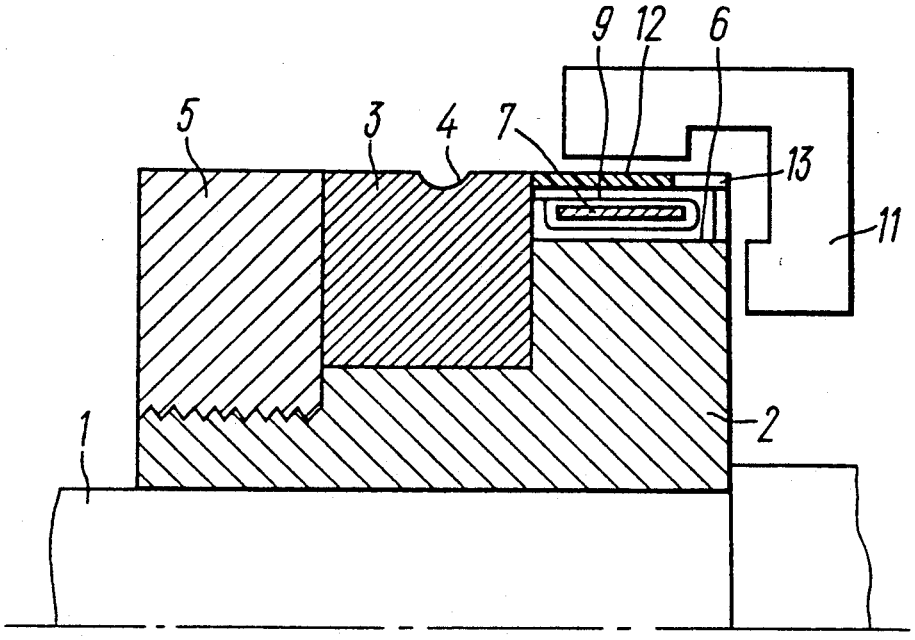
FIG. 3 is a view of the rolling-mill roll of FIG. 1 showing an alternative embodiment of the electrochemical wear protection element as seen in longitudinal section.

Now reference is directed to FIG. 3 illustrating an alternative embodiment of the element for protection of the present roll against electrochemical wear, said embodiment being applicable in the case where the roll diameter is substantially small so that the coil 7 cannot be accommodated in the additional slot 6 provided in the end face of the sleeve 2. In this case the additional slot 6 is provided on the outer side of the diameter of the sleeve 2 as shown in FIG. 3.

Figure 4:
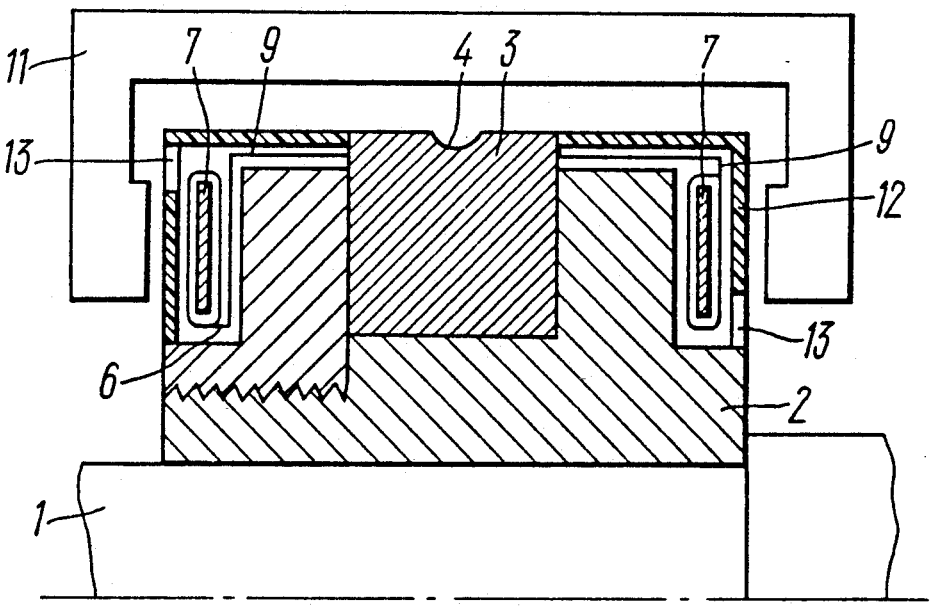
FIG. 4 illustrates the same rolling-mill roll showing one more embodiment of the element for protection of the hard-alloy insert working surface against electrochemical wear as seen in longitudinal section.

When rolling large-sized copper sections, use is made of an embodiment of the element for protection of the hard-alloy insert 3 against electrochemical wear as presented in FIG. 4.

In the embodiment considered herein two additional slots 6 are provided, which are arranged oppositely to the hard-alloy insert 3, one of said additional slots 6 being made in the sleeve 2, and the other, in the nut 5.

Each of the additional slots 6 accommodates the coil 7 covered with the guard 12, and the permanent magnet 11 is so shaped as to enable the magnetic field is free to thread the turns of both coils 7.

The rolling-mill roll of the present invention operates as follows.

In the course of the hot rolling process, a coolant fluid is fed to the revolving roll, said fluid being admitted to pass through the opening 13 (FIG. 1) to the additional slot 6 and onto the coil 7. A magnetic field is built up due to the fact that the permanent magnet 11 is located close to the coil 7, an electromotive force being generated in the turns of the coil 7 as the latter, while rotating, crosses said magnetic field. With the roll revolving clockwise the negative potention of the electromotive force is directed, via the parts 8 of the turns of the coil 7 and along the conductor 9 to the hard-alloy insert 3, further to the metal being rolled and whence through the coolant fluid serving as electrolyte, to the parts 10 of the turns of the coil 7 which are in electric contact with the coolant fluid.

Thus, cathodic protection is afforded to the working surface 4 of the hard-alloy insert 3 against electrochemical wear, thereby adding to the service durability of the roll.

In a given particular case the concept of cathodic protection is based on polarization of the cathode (i.e., the metal being rolled) up to the potential of the anode (i.e., the hard-alloy insert), with the result that the potential difference at the contact interface between the working surface 4 of the hard-alloy insert 3 and the metal being rolled equals zero so that no dissolution of the working surface 4 of the hard-alloy insert 3 occurs.

In the case of low rolling speeds use may be made of an electromagnet (solenoid) as a direct current source.

The afore-described cathodic protection of the working surface 4 of the hard-alloy insert 3 established by the proposed construction of the electrochemical wear protection element, rules out any influence on the wear of other rubbing components of a rolling mill, is safe for the attending personnel since no electromotive force is generated until the rolling mill operates.

Moreover, such a cathodic protection enables the use of rolls made of any wear-resistant materials, hard alloys inclusive, in modern high-speed rolling mills.

As a rule, the principle of this invention remains the same as described above, though the components of the construction may be varied within a wide range as compared with those described hereinabove for the sake of example, but falling within the spirit and scope of the present invention.

What we claim is:

1. A rolling-mill roll, comprising:

a mandrel;

a sleeve mounted on said mandrel and having a slot;

a hard-alloy insert having a working surface and disposed within said slot;

coolant fluid for cooling the roll;

at least one inductor coil located on said sleeve and having an outer surface and an inner surface;

a plurality of turns arranged on said at least one inductor coil having outer sections located above said outer surface and inner sections located above said inner surface;

said outer sections being electrically coupled to said hard-alloy insert;

said inner sections being immersed in said coolant fluid;

a magnet fixedly mounted adjacent said at least one inductor coil, said magnet establishing a direct current source; and wherein said magnet and said at least one inductor coil cooperatively form a protection element for protecting said working surface of said hard-alloy insert.

2. The rolling-mill roll as claimed in claim 1, wherein said sleeve has at least one coil-receiving slot, wherein said at least one inductor coil is disposed within said at least one coil-receiving slot.

3. The rolling-mill roll as claimed in claim 2, wherein said sleeve has two coil-receiving slots located on opposite sides of said hard-alloy insert.

* * * * *